United States Patent [19]

Crow et al.

[11] Patent Number: 4,922,066

[45] Date of Patent: May 1, 1990

[54] ENVIRONMENTALLY PROTECTED SWITCH FOR DYNAMOELECTRIC MACHINES

[75] Inventors: William D. Crow, St. Louis County; Ronald D. Williams, St. Charles County, both of Mo.

[73] Assignee: Emerson Electric Co., St. Louis, Mo.

[21] Appl. No.: 322,524

[22] Filed: Mar. 13, 1989

[51] Int. Cl.[5] ..... H01H 35/10

[52] U.S. Cl. ..... 200/80 R; 73/535; 200/302.1; 310/68 E

[58] Field of Search ..... 73/535, 546, 550; 310/68 E; 318/462, 793; 307/120; 200/80 R, 83 C, 246, 249, 283, 292, 302.1

[56] References Cited

U.S. PATENT DOCUMENTS

| | | | |
|---|---|---|---|
| 2,747,854 | 5/1956 | Schnepf | 73/550 |
| 3,433,908 | 3/1969 | Cunningham | 200/80 R |
| 3,950,628 | 4/1976 | Hruda | 200/302.1 |
| 4,289,988 | 9/1981 | Schaefer | 310/68 E |
| 4,414,443 | 11/1983 | Gehrt | 200/80 R |
| 4,633,213 | 12/1986 | Venema | 200/83 C |

*Primary Examiner*—Gerald P. Tolin

*Attorney, Agent, or Firm*—Polster, Polster and Lucchesi

[57] ABSTRACT

A switch assembly for use with a centrifugal actuator in the start winding circuit of a dynamoelectric machine (1). The switch has a pair of electrical contacts (29, 33) contained in a pliable, bellows-like enclosure (37) for protection from foreign matter. The assembly includes a terminal board (19) having an electrically conductive post (28) mounted thereon and comprising one side of the switch. A second contact, comprising the other side of the switch, is directly above the first and is surrounded by an electrically conductive cap (32). The cap is affixed between the ends of an electrically conductive, cantilevered switch arm (16) which is biased against a vertically rigid, horizontally adjustable stop (45). The stop has one end rigidly mounted to the terminal board and its other end above and in contact with the switch arm where the cap is affixed to the arm. The bias is caused by the switch arm support structure at the fixed end being attached to the terminal board at an angle. Moving the end of the stop contacting the arm toward the support structure, decreases the gap between the switch contacts, while moving the end of the stop towards the free end of the switch arm increases the gap.

20 Claims, 2 Drawing Sheets

FIG. 2.
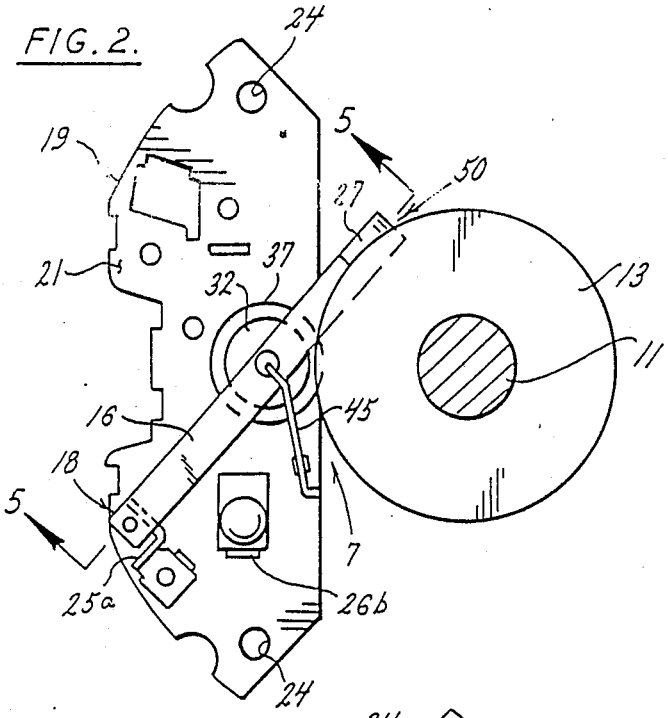
FIG. 3.
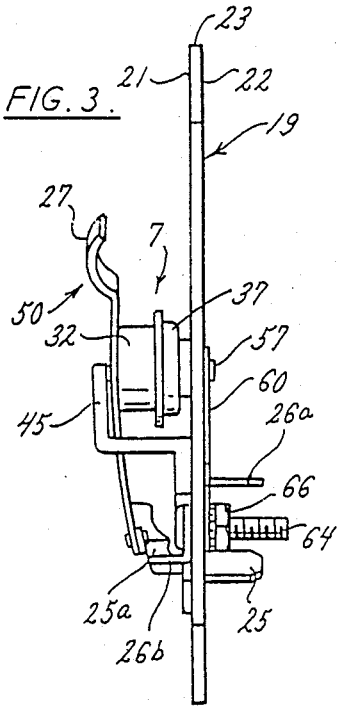
FIG. 4.
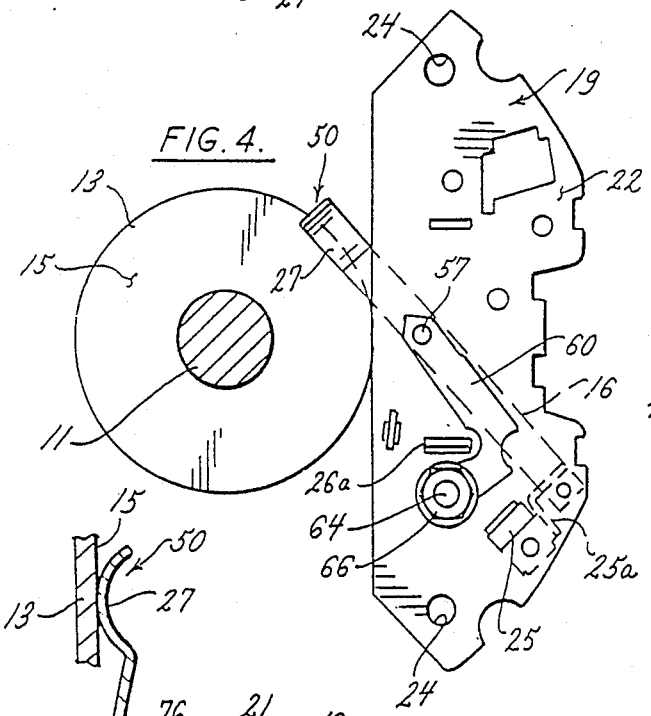
FIG. 5.
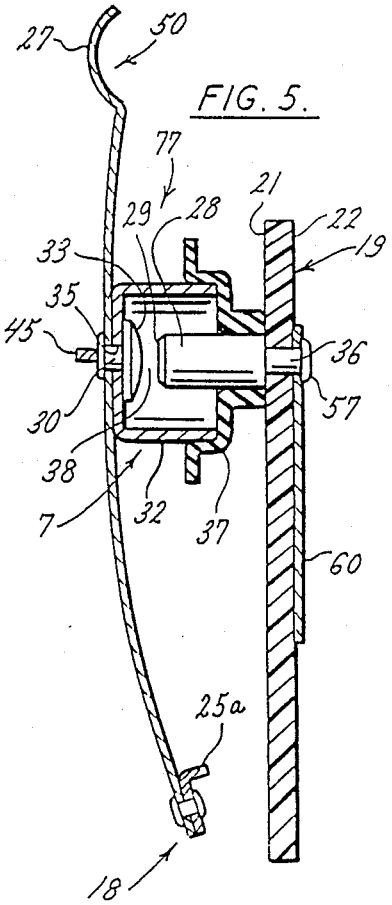
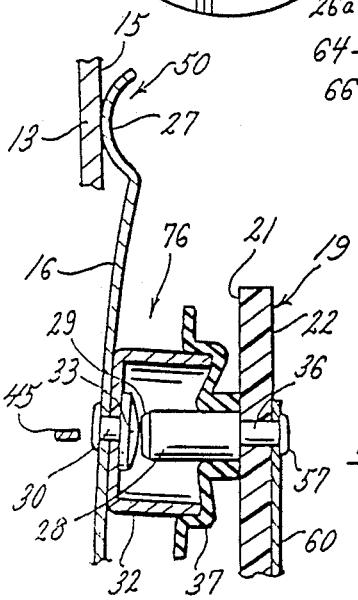
FIG. 6.

ENVIRONMENTALLY PROTECTED SWITCH FOR DYNAMOELECTRIC MACHINES

BACKGROUND OF THE INVENTION

This invention relates to an electrical switch, and in particular to an electrical switch used in the start circuit of a dynamoelectric machine.

There are applications for dynamoelectric machines, such as motors and generators, which require operation in environments containing high levels of airborne contaminants including particulate and abrasive matter. In industrial applications there often are a myriad of airborne industrial pollutants and contaminants present in areas of motor operation. Moreover, even in the home environment, an application of a motor such as in a power saw, exposes the motor to wood dust created during a sawing operation. This, too, can effect the operation of the motor powering the saw. Even insects are of concern in some applications.

Contaminants are of particular concern because of their possible effect on the switching operation that occurs during motor starting operation. Contaminants, regardless of their source, have direct access to the switch contacts used in the motor start circuits. The effect of contaminants can vary from simple arcing across switch contacts to switch failure. In applications where a high level of pollution or contamination exists, the entire motor or generator is sealed to prevent such failure. When a machine is sealed, however, heat generated during its operation is not as easily dissipated as it is from an unsealed machine.

To address the heat dissipation problem, sealed machines are constructed larger in size than comparable open machines and are thus, heavier, and costlier. The size, weight and cost penalties associated with sealed machines is good reason to use open machines where applications permit, even though the operating environment will subject the machine to environmental contamination and performance degradation. It will be understood that where an open motor is used in an environment known to be contaminated with particulate matter such as saw dust, or chemical compounds which are, for example, acidic in nature, a price will be paid at some point. Materials will deteriorate and degrade, and performance will, in time, suffer. With respect to the present invention, unprotected switching functions quickly degrade in an atmosphere laden with sawdust or other industrial dusts, or other particulate matter that deposits on the switch contacts and interferes with switch action. Switching may become intermittent and unreliable, and arcing will cause pitting on the contacts and other detrimental effects.

The types of motors normally employed in the above described environments are frequently split phase or capacitor start induction motors. They generally employ a centrifugal actuator acting upon a switch of the type contemplated by the present invention to control application of power to the motor's start circuit. When power is first applied to such a motor, the centrifugal actuator, which is mounted on the motor shaft, is mechanically in contact with one side of the switch, causing it, in turn, to close upon the other side of the switch and connect the motor start winding to the motor power source. With the start winding thus connected, the rotor begins to turn, gradually increasing its speed. Upon reaching a predetermined operating speed, the centrifugal actuator pulls away from the side of the start winding switch that it is contacting. The switch opens and removes the start winding from the power source. The main motor winding provides for motor operation thereafter. If the start switch and its associated actuator are exposed to a contaminated operating environment, their performance is so effected that they may be incapable of functioning. The motor may fail because the start winding cannot get power, or the start winding cannot be disengaged and either fails or causes nuisance trips of any associated motor protection device.

Many types of switches, and ways for protecting them are known to those familiar with the art. One example is disclosed in U.S. Pat. No. 4,414,443 ('443), the disclosure of which is intended to be incorporated herein by reference. While the prior art in general and the '443 patent in particular work well for their intended purposes, their use is not without drawbacks. In particular, the structure used to protect the switch is relatively expensive, It also is difficult to maintain alignment of the switch components with prior art designs, particularly over the useful life of the motor.

The present invention offers a simple, easily producible, and inexpensive means for protecting a set of motor switch contacts used in a highly contaminated environment. The invention remains remarkably free from the adverse effects of the operating environments above described. In the present invention, one switch contact located intermediate the ends of a flexible conductive arm, is surrounded by a protective metal shell or cap. The cap is open in the direction of a mating contact which is on the end of a post that is attached to a terminal board on which the entire switch assembly is mounted. A soft, pliable boot surrounds the post and fits about the cap, enclosing the mating contact on the flexible arm. Thus the entire switching environment; that is, the environment to which the switch contacts are exposed, is sealed off by the mating cap and boot. It has also been found that the combination cap, post, and boot help maintain alignment of the switch contacts during repetitive opening and closing of the switch. This combination of elements has resulted in extremely long switch life, even in adverse operating environmental conditions.

It is an object of the present invention to provide an improved switch for dynamoelectric machines operating in contaminated environments.

Another object of the invention is to provide a switch having contacts enclosed so as to inhibit the effects of the external environmental contaminants.

Still another object of the invention is to provide a protected switch for use in dynamoelectric machines operating in contaminated environments which is simple in design and operation, and inexpensive to produce.

Yet another object of the invention is to provide a motor starting switch assembly for use in a dynamoelectric machine employing a centrifugal actuator.

A further object of the invention is to provide a switch assembly which maintains switch contact alignment so to increase the useful life of the assembly.

These and other objects of the present invention will be more clearly understood after reference to the drawings and the description accompanying them which follows.

SUMMARY OF THE INVENTION

In accordance with the present invention, generally stated, a two contact switch assembly for use in dynamoelectric machines is provided for a switch assembly normally intended to be used with a centrifugal actuator to make or break the switch contacts. The switch, in the preferred embodiment, is mounted to a terminal board. A first contact of the switch is mounted at, or near the end of a conductive post. A second end of the post is attached to the terminal board. A second contact for the switch is located between the ends of a flexible, electrically conductive arm which is cantilevered from a fixed mounting point on the terminal board. The free end of the arm curves upwardly away from the terminal board. The shape of the free end is designed to form a slideable contact against which a flat, rotating surface, such as a movable portion of the centrifugal actuator, presses. Movement of the actuator in one direction causes the arm to move in the direction of the terminal board and close the switch contacts. Movement of the actuator in a second direction causes the arm to move away from the board, opening the switch contacts. The switch contacts are mounted in alignment during fabrication so when the flexible arm moves down toward the first contact, direct positive contact between the contacts is made. The second contact is surrounded by a metal cap. The metal cap has a centrally located hole formed in it, which permits the neck of the contact to pass therethrough, for attaching both the contact and the enclosing cap to the flexible arm by any convenient method.

A metal stop has one end rigidly attached to the terminal board. The stop uses above the board and has a second end movably located in a plane parallel to the plane of the terminal board. The stop is positioned above and contacts the flexible arm at the point where the second contact and metal cap are attached to it. This limits the upper most excursion of the second contact. By adjusting the contact point between the stop and the top of the arm toward the fixed or free end of the arm, the gap between the first and second contacts can be decreased or increased.

A soft, pliant, rubber-like or neoprene boot has a small diameter opening at one end and a larger diameter opening at its opposite end. The small diameter end of the boot snugly fits down upon and slideably adheres to the post; while its opposite, larger diameter end fits snugly about and adheres slideably upon the metallic cap. Thus, the boot encloses the switch contacts and protects them from the surrounding environment. Between the two contacts, the boot acts in the nature of a bellows. As long as the boot remains snugly intact and slideably adheres in contact with the post, the integrity of the enclosed environment for switch contacts is maintained.

BRIEF DESCRIPTION OF THE DRAWINGS

In the drawings.

FIG. 2 is a top plan view taken along the line 2—2 of FIG. 1, illustrating the relationship of the switch and its related centrifugal actuator;

FIG. 3 is a side view of the switch shown in FIG. 1;

FIG. 4 is a bottom plan view of the switch of this invention, taken along the line 4—4 of FIG. 1;

FIG. 5 is a sectional view taken along the line 5—5 of FIG. 2 showing the open position of the switch; and FIG. 6 is a partial, sectional view corresponding to FIG. 5, but showing the closed position of the switch.

DESCRIPTION OF THE PREFERRED EMBODIMENT

Figure 1:
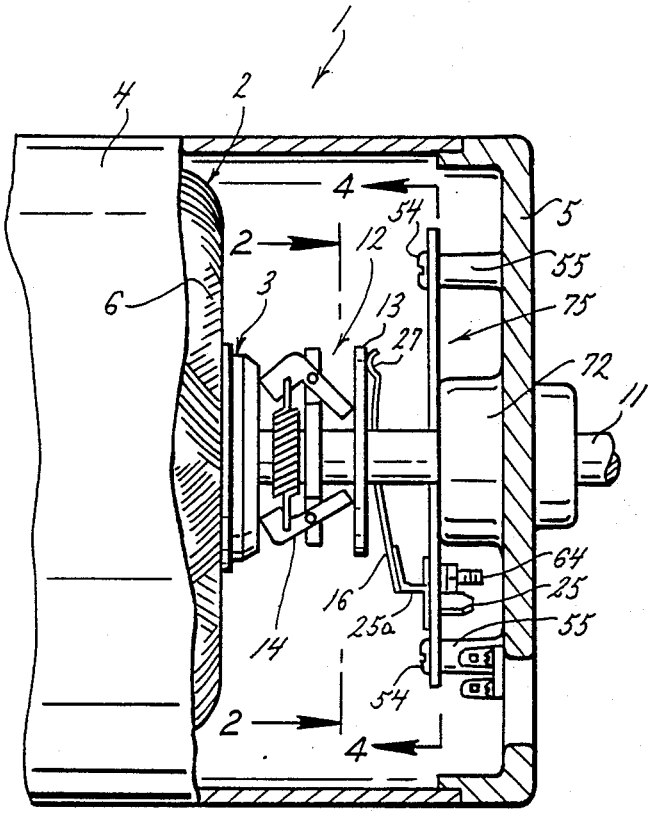
FIG. 1 is a view in side elevation, partly broken away and partly in section, showing one illustrative embodiment of the present invention mounted within a dynamoelectric machine.

Referring now to FIG. 1, reference numeral 1 indicates one illustrative dynamoelectric machine in the form of an induction motor in which the present invention finds application. In the embodiment illustrated, motor 1 includes a stator assembly 2 and rotor assembly 3 which are housed within a motor shell 4. The motor shell 4 is normally at least partially closed at each end by a pair of end shields 5, only one of which is shown in the drawings. As is well known in the art, rotor assembly 3 is mounted to a shaft 11. Press or shrink fits work well for such mounting, for example. The shaft 11 is journalled in bearings 72 installed in each end shield 5. The shaft 11 extends through at least one end of the shield 5 to provide the mechanical output for the motor.

A centrifugal actuator 12 also is mounted to shaft 11. The actuator 12 rotates with the shaft 11. Attached to the actuator 12 is a washer-shaped collar 13, also shown in FIGS. 2 and 4, which has central opening for it to fit over the shaft 11. The collar moves axially along the shaft 11 as centrifugal force causes a centrifugal clutch mechanism 14 to move radially outwardly during rotation of rotor 3. When the rotor 3 is stopped, collar 13 has a face 15 which remains in contact with the free end 50 of an electrically conductive switch arm 16. The switch arm 16 is fabricated from a conductive spring metal. A connection assembly 75 is shown mounted to end shield 5 at mounting points 55. The assembly 75 includes a terminal board 19 and a switch assembly 7. As shown in FIGS. 1 and 2, the connection assembly 75 is attached to end shield 5 by mounting bolts 54 which pass through corresponding openings 24 the terminal board 19.

As will be recognized by those skilled in the art, the end shield 5 commonly has an access area or opening in it. The opening provides operator or installer access for making electrical connections to the terminal board 19. Such connections are required to provide electrical power to the motor from a source not shown, for electrical energization of the motor windings, indicated generally by reference numeral 6 in FIG. 1. Conventionally, the windings include a main winding and an auxiliary winding. The auxiliary or start winding is disconnected from the motor electrical circuit by the operation of the switch assembly 7 of this invention.

As shown in FIGS. 2 and 3, the switch assembly 7 is mounted to a terminal board 19. Terminal board 19 is generally planar, having a first face or side 21 and a second face or side 22 having a material thickness 23 between them. The terminal board 19 is fabricated from melamine or a similar non-conductive material known to those skilled in the art. Face 22 of the terminal board has at least a first male quick connect terminal **26*a* and a second male quick connect terminal 25 extending outwardly from it. These are mounted to the terminal board 19 by, for example, rivets; or as shown in FIGS. 3 and 4, by a bolt 64 and a keep nut 66. As also shown in FIG. 2, a first end 18 of switch arm 16 is attached to a support structure 25*a* on the side 21 of terminal board 19 by any convenient method. It will be understood any means of reliable attachment may be used. The terminal 25 is electrically connected to the support structure 25*a* through the terminal board 19. The second, free end 50, as indicated above, includes the contact area 27. Contact area 27 preferably has an arcuate shape for sliding contact with collar 13 of centrifugal actuator 12**.

A stop 45 is rigidly attached to and through terminal board 19, as shown in FIGS. 2, 3 and 4. Stop 45 limits the maximum distance of travel of the switch arm 16 away from terminal board 19, and thus determines the width of a gap 38 between a contact 33 on switch arm 16 and an electrical contact 29 on post a 28 of a switch assembly 7. Gap 38 is decreased by moving stop 45 towards fixed end 18 of the switch arm 16 and increased by moving stop 45 towards free end 50 of the switch arm 16.

Terminal 26*a* is a double-ended, male quick disconnect which extends through terminal board 19 to define a terminal 26*b*, which in turn is connected to a flat conductor 60 on the side 22 of terminal board 19 by means of bolt 64 and keep nut 66. This connection is more easily seen in FIG. 4. As indicated, terminal 25 is integrally connected to support structure 25*a* which, in turn, is directly connected to switch arm 16, shown in FIGS. 2 and 3. Support structure 25*a* is affixed to the terminal board 19 at an angle of, for example, approximately 15° ±1°off vertical, referenced to FIG. 3. This mounting technique biases switch arm 16 against stop 45, in a second position 77 of switch assembly 7, as discussed further herein.

Referring to FIG. 5, conductor 60 is held flat against face 22 of terminal board 19. This is done by an integrally formed head 57 of a centrally located neck 36 which extends through terminal board 19 and forms part of the post 28. Electrical contact 29, which is at or affixed atop post 28, is connected to conductor 60; and, in turn, to the double-ended, male quick-disconnect terminals 26*a*–26*b*. Contact 29 and its associated electrical path then constitutes one side of switch assembly 7. Contact 29 preferably is fabricated of an erosion resistant conductive metal. Alternately, it may comprise a treated area at the top of post 28. In either event, the purpose is to inhibit contact erosion caused by electrical arcing. Electrical contact 33 is enclosed in a cap 32, which is fabricated of a brass or other electricaly conductive material. Cap 32 has a central opening 35 formed in it. Contact 33 includes an intermediate neck portion 30 which fits through opening 35 in the arm 16 to hold the contact 33 in place. Electrical contact 33, cap 32, switch arm 16, and support structure 25*a*, are all commonly connected to electrical terminal 25 on side 22 of terminal board 19 (as shown in FIG. 4) to form the second side of switch assembly 7.

A boot 37 is seen in FIG. 5 as protectively and snugly surrounding and slideably adhering to post 28. The boot 37 also surrounds and slideably adheres to the outer surface of the open end of cap 32 which, in turn, protectively and snugly surrounds contact 33. Boot 37 preferably is fabricated from a neoprene or similar type material. It will be appreciated that cap 32 and boot 37 isolate the electrical contacts from the surrounding environment. This series to prevent pollution or contamination from affecting the contacts and prolongs their useful life.

In FIG. 5, the switch arm 16 is positioned against stop 45. This is its maximum distance of travel away from the face 21 of terminal board 19. This second position 77 of switch arm 16 relative to face 21 of terminal board 19 results in the gap 38 existing between electrical contact 33 on switch arm 16 and electrical contact 29 on post 28. This condition exists when centrifugal actuator 12 is out of contact with area 27 at free end 50 of switch arm 16. Position 77 corresponds to the condition when motor 1 has reached an operating speed where switch assembly 7 is in its open condition and the start winding is disconnected from the energy source. Preferably, gap 38 can be adjusted to 0.035 inches, ±0.010 inches.

When connection assembly 75 is properly mounted on an end shield 5, or at another appropriate point with respect to the motor 1, the motor is made operative by connecting either terminal 26A or 25, to one side of the power source and terminal 26*b* to one side of the start winding of the motor. Immediately before application of power, motor 1 is not running and centrifugal actuator 12 is at rest against contact area 27 on free end 50 of switch arm 16, as shown in FIG. 6. Contact 33 on switch arm 16 directly abuts electrical contact 29 on top of post 28. This is a first position 76 of switch arm 16 relative to face 21 of the terminal board 19. In this position, electrical energy, when applied, is supplied to the start winding, causing the motor to begin operating. As the motor reaches a percentage of its normal operating speed, for example 75 percent thereof, centrifugal actuator 12, and in particular, collar 13, pulls away from contact area 27 causing separation of contacts 29 and 33. As shown in FIG. 5, gap 38 is created as switch arm 16 comes to rest against stop 45 in the second position 77 or switch assembly 7. In position 77, switch assembly 7 is open and the start winding of the motor is removed from operation.

The width of the gap 38, i.e. the distance between contacts 29 and 33, is adjusted by moving stop 45 in the direction of either fixed end 18 or the free end 50 of switch arm 16. Switch arm 16 is cantilevered, that is, the fixed end 18 of arm 16 is attached to support structure 25*a*. As noted, structure 25*a* is tilted at an angle off vertical. Thus, switch arm 16 is biased as a flat spring against stop 45. By moving stop 45 toward the fixed end of switch arm 16, the biasing force of the arm against stop 45 is increased and gap 38 is decreased. On the other hand, if stop 45 is moved in the direction of free end 50 of switch arm 16, the biasing force of switch arm 16 against stop 45 is decreased and the width of gap 38 is increased.

As thus described, a simple and highly reliable switch structure is disclosed. The pliable boot 37, while flexing to permit switch operation, allows the contacts 29 and 33 to remain aligned properly. We have found it to increase contact life dramatically.

It should be obvious to those skilled in the art that many variations of the present invention as disclosed and claimed herein are possible without departing from the coverage of the invention as claimed.

Having thus described the invention, what is claimed and desired to be secured by Letters Patent is:

1. A switch for use in a dynamoelectric machine having a start winding connected to a power source, said switch operating to remove the start winding from the motor circuit when the machine reaches its operating speed, comprising:

first and second electrical contacts, one of said first and said second electrical contacts being electrically connected to a source of power and the other of said first and said second electrical contacts being electrically connected to the start up winding;

means responsive to the speed of the machine for effecting electrical contact between the first and second electrical contacts during machine start up and for breaking the electrical contact as the machine reaches its operating speed; and, means for protecting both of the first and second electrical contacts from the environment in which the machine operates, said protecting means including a rigid electrically conductive cover fitted over one of the contacts and a pliable, non-electrically conductive boot fitted over the other contact, one end of the pliable boot intermounting one end of the cover, said pliable boot flexing to permit electrical interconnection of the first and second contacts during operation of the switch.

2. The switch assembly of claim 24 wherein the first electrical contact comprises an electrically conductive post.

3. The switch assembly of claim 2 including means for supporting said first electrical contact comprising an electrically non-conductive terminal board, said post being attached to said terminal board.

4. The switch assembly of claim 3 further including an electrically conductive means for attaching the post to said terminal board; and, an electrically conductive means for connecting said attaching means to one of a source of electrical energy and said dynamoelectric machine.

5. The switch assembly of claim 3 further comprising an electrically conductive cap having an open end and a closed end, said second electrical contact being enclosed by said conductive cap.

6. The switch assembly of claim 5 further including an electrically conductive switch arm having a first end and a second end, said second electrical contact being mounted to said switch arm, and electrically conductive means for supporting said arm, said arm supporting means being attached to said terminal board at one of said first and said second ends of said arm to hold it cantilevered above the terminal board such that the electrical contact within said cap attached to said arm is directly over the top of said post; and, means for connecting said arm to the other of said source of electrical energy and said dynamoelectric machine.

7. A switch assembly for a dynamolectric machine comprising:

support means including an electrically non-conductive terminal board, said terminal board having a first side and a second side;

first electrical contact means mounted to the first side of said terminal board, said first electrical contact means including an electrically conductive post, and means for attaching said post to said terminal board, said last mentioned attaching means connecting said post to one of a source of electrical energy and said dynamoelectric machine;

an electrically conductive switch arm having a first end and a second end, means for attaching said switch arm to said terminal board at one of said first and said second ends, said attaching means holding said switch arm cantilevered above the terminal board, and means for connecting said support means to the other of said source of electrical energy and said dynamoelectric machine;

a first electrical contact mounted to said post;

a second electrical contact mounted intermediate the ends of said switch arm;

means for enclosing said first and said second electrical contacts to isolate the contacts from the environment in which the machine operates to prolong the life of the contacts, said enclosing means including an electrically conductive cap which encloses said second electrical contact and a flexible portion, said flexible portion including a pliable non-conductive boot having first and second ends, one end of said boot being in snug contact with the outer surface of said post and the other end of said boot being in snug contact with an outer surface of said cap so as to close the open end of said cap, said first and said second contacts being aligned with one another and positioned to permit electrical connection with said contacts when an external force is applied to one of said contacts.

8. The switch assembly of claim 7 wherein said electrically conductive means for mounting the bottom post to said terminal board comprises an electrically conductive neck of post material extending from the bottom of said post through a hole in said terminal board, and being affixed to said terminal board by a head formed at the end of said neck opposite said post.

9. The switch assembly of claim 8 wherein said electrically conductive means for connecting said means for attachment comprises a flat conductor having two opposite ends, and means for lug connection attached to said terminal board, said flat conductor being flush mounted with one surface of said terminal board and affixed by one end to said neck by said head, and by its other end to said means for lug connection.

10. The switch assembly of claim 9 further comprising means for limiting travel of said switch arm in a direction away from said terminal board, said limiting means being adjustable to adjust the air gap between the contacts of said switch assembly.

11. The switch assembly of claim 10 wherein said electrically conductive means for support of said arm, and from which said arm is attached, is mounted to said terminal board at an angle off vertical sufficient to bias said arm against said means for limiting its travel.

12. The switch assembly of claim 11 wherein said means for limiting the travel of said conductive switch arm comprises a stop, said stop having one end rigidly attached to said terminal board and a second end which rises up and over said cap to make contact with the side of said arm at a point along said arm.

13. The switch assembly of claim 12 wherein the end of said stop which rises up and over said cap is adjustable so when moved rotatably in one direction the gap between the contact on said arm and the top of said post is decreased, and, when moved rotatably in the opposite direction the gap will increase.

14. The switch assembly of claim 13 wherein said conductive switch arm is constructed of flat spring material.

15. The switch assembly of claim 14 wherein said pliable boot is fabricated of soft rubber-like material.

16. The switch assembly of claim 15 wherein said cap is fabricated from a brass-type material.

17. The switch assembly of claim 16 wherein an electrical contact of material different from that which is used to fabricate said electrically conductive post is affixed to the top end of said post.

18. The switch assembly of claim 15 wherein the top of said electrically conductive post is treated to resist erosion caused by arcing when said electrical contact within said electrically conductive cap is moved apart from contact with the top of said post, thus breaking the circuit connected to a source of electrical energy.

19. A switch assembly for a dynamoelectric machine, comprising:

a terminal board having a first side, a second side and a material thickness in between;

at least one conductive post having its bottom affixed to the first side of said terminal board and its top accessible above said first side, said post constituting one side of said switch assembly for connection to one of two open connections in an electrical circuit required to be linked;

an electrically conductive, flexible switch arm having a fixed end attached to the first side of said terminal board and a free end cantilevered at an angle above horizontal and the first side of said terminal board, directly above the top of said post, said switch arm constituting the second side of said switch assembly for connection to the other of two open connections in an electrical circuit required to be linked;

an electrical contact affixed to said switch arm between said free and fixed ends directly above and facing the top of said post;

a conductive, protective cap having an open top and a closed bottom, and having a portion of said contact affixed to said arm extending through a central point in said closed bottom to affix said cap to said arm;

a stop having a first end rigidly attached to the first side of said terminal board and a second end which rises up and over said arm above said cap to adjustably limit the travel of said arm away from the first side of said terminal board when no external force is applied to the free end of said arm to cause its movement away from said stop towards said terminal board, said second end causing the contact attached to said arm to move closer to the top of said post when said second stop end is rotatably moved towards the fixed end of said arm, and causing said contacts to move apart when said second stop end is rotatably moved towards the free end of said arm; and a flexible, bellows-like boot having one end sized for and mounted snugly about and enclosing said post; and an opposite end sized for and mounted snugly about said cap to enclose the open end of said cap.

20. In a dynamoelectric machine, the improvement comprising:

a terminal board mounted to said dynamoelectric machine;

a first means for electrical contact having an accessible top and an opposite bottom affixed to a first surface of said terminal board;

a flexible second means for electrical contact having a first end rigidly affixed to the first surface of said terminal board, an opposite, free second end, and an electrical contact between said first and second ends, said free second end movably located in alignment with and adjacent to the top of said first means so that application of force to the free second end of said second means for electrical contact will cause the contact thereon to close on top of said first means;

means affixed to said terminal board for limiting the movement of the free end of said second means from said first means;

means for enclosing the electrical contact on said flexible second electrical contact means and said first electrical contact means, said enclosing means comprising a cap enclosing said electrical contact on said flexible second means, and a pliable boot portion having one end being in snug contact with said first electrical contact means and another end being in snug contact with said cap;

an electrically conductive means for connecting the bottom of said first means for electrical contact to one of a source of electrical energy and said dynamoelectric machine; and an electrically conductive means for connecting said flexible second means for electrical contact to the other of said source of electrical energy and said dynamoelectric machine.

* * * * *